US006568623B1

(12) United States Patent
Adcock et al.

(10) Patent No.: US 6,568,623 B1
(45) Date of Patent: May 27, 2003

(54) METHOD FOR CONTROLLING WIND ANGLE AND WAYWIND DURING STRAND PACKAGE BUILDUP

(75) Inventors: Joseph Anthony Adcock, Heath, OH (US); Douglas Brian Mann, Evans, GA (US); Donald Scarsella, Newark, OH (US); Eugene V. Galloway, Anderson, SC (US)

(73) Assignee: Owens-Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/528,949

(22) Filed: Mar. 21, 2000

(51) Int. Cl.[7] ..... B65H 54/38
(52) U.S. Cl. ..... 242/477.6; 242/477.4
(58) Field of Search ..... 242/477.4, 477.6, 242/477.5

(56) References Cited

U.S. PATENT DOCUMENTS

| | | | | |
|---|---|---|---|---|
| 3,367,587 A | | 2/1968 | Klink et al. | |
| 3,514,682 A | | 5/1970 | Corey | |
| 4,296,889 A | | 10/1981 | Martens | |
| 4,371,122 A | | 2/1983 | Schuller | |
| 4,515,320 A | * | 5/1985 | Slavik et al. | 242/478.2 |
| 4,667,889 A | | 5/1987 | Gerhartz | |
| 4,676,441 A | * | 6/1987 | Maag | 242/477.4 X |
| 4,697,753 A | * | 10/1987 | Schippers et al. | 242/477.6 |
| 4,771,961 A | * | 9/1988 | Sugioka | 242/477.4 |
| 4,779,813 A | | 10/1988 | Sugioka et al. | |
| 4,789,112 A | * | 12/1988 | Schippers et al. | 242/178 |
| 5,009,373 A | | 4/1991 | Hester | |
| 5,056,724 A | | 10/1991 | Prodi et al. | |
| 5,439,184 A | | 8/1995 | Poppinghaus et al. | |
| 5,447,277 A | | 9/1995 | Schluter et al. | |

FOREIGN PATENT DOCUMENTS

| | | |
|---|---|---|
| DE | 40 24 218 | 2/1992 |

* cited by examiner

*Primary Examiner*—Michael R. Mansen
(74) *Attorney, Agent, or Firm*—Inger H. Eckert; James J. Dottavio

(57) ABSTRACT

A moving strand is provided and a size is applied to the strand. A collet is rotated to wind the strand and build a package. The strand is reciprocated with a strand reciprocator to lay the strand at a wind angle on the package surface as the package rotates. A rotatable collet receives the strand to build a package. A strand reciprocator is mounted to guide the strand from edge to edge of the package and to lay the strand in a helical pattern on the package surface as the package rotates. The collet and the cam for the strand reciprocator are driven by motors. A collet inverter drive and a cam inverter drive control the rotational speed of the collet and cam, respectively. A controller is operatively connected to control the collet and cam inverter drives. A memory device such as a computer provides information to the controller of the waywind and wind angle as a function of package buildup time. An encoder can be operatively connected to each motor to provide feedback information to the controller relating to the rotational speed of the collet and the cam. The wind angle can remain constant while the relative rotational speed of the collet and the cam are varied as a function of package buildup time. Alternatively, the wind angle and the relative rotational speed of the collet and the cam can be varied as a function of package buildup time.

5 Claims, 8 Drawing Sheets

METHOD FOR CONTROLLING WIND ANGLE AND WAYWIND DURING STRAND PACKAGE BUILDUP

TECHNICAL FIELD

This invention relates to the production of glass fibers, and in particular, to winding a glass fiber strand to form packages. More particularly, this invention relates to controlling the cam speed for optimum winding angles during package buildup.

BACKGROUND OF THE INVENTION

Mineral fibers are used in a variety of products. The fibers can be used as reinforcements in products such as plastic matrices, reinforced paper and tape, and woven products. During the fiber forming and collecting process numerous fibers are bundled together as a stand. Several strands can be gathered together to form a roving used to reinforce a plastic matrix to provide structural support to products such as molded plastic products. The strands can also be woven to form a fabric, or can be collected in a random pattern as a fabric. The individual strands are formed from a collection of glass fibers, or can be comprised of fibers of other materials such as other mineral materials or organic polymer materials. A protective coating, or size, is applied to the fibers which allows them to move past each other without breaking when the fibers are collected to form a single strand. The size also improves the bond between the strands and the plastic matrix. The size may also include bonding agents which allow the fibers to stick together, thereby forming an integral strand.

Typically, continuous fibers, such as glass fibers, are mechanically pulled from a feeder of molten glass. The feeder has a bottom plate, or bushing, which has anywhere from 200 to 10,000 orifices. In the forming process, the strand is wound around a rotating drum, or collet, to form, or build, a package. The completed package consists of a single long strand. It is preferable that the package be wound in a manner which enables the strand to be easily unwound, or paid out. It has been found that a winding pattern consisting of a series of helical courses laid on the collet builds a package which can easily be paid out. Such a helical pattern prevents adjacent loops or wraps of strand from fusing together should the strand be still wet from the application of the size material. The helical courses are wound around the collet as the package begins to build. Successive courses are laid on the outer surface of the package, continually increasing the package diameter, until the winding is completed and the package is removed from the collet. The waywind is the number of rotations of the collet during the traverse of the cam follower and guide eye from one end of the package to the other (usually a number between 2 and 4).

A strand reciprocator guides the strand longitudinally back and forth across the outer surface of the package to lay each successive course. A known strand reciprocator is the spiral wire type strand oscillator. It consists of a rotating shaft containing two outboard wires approximating a spiral configuration. The spiral wires strike the advancing strand and direct it back and forth along the outer surface of the package. The shaft is also moved longitudinally so that the rotating spiral wires are traversed across the package surface to lay the strand on the package surface. While building the package, the spiral wire strand oscillator does not contact the package surface. Although the spiral wire strand oscillator produces a package that can be easily paid out, the package does not have square edges.

A known strand reciprocator which produces square edged, cylindrical packages includes a cam having a helical groove, a cam follower which is disposed within the groove and a strand guide attached to the cam follower. As the cam is rotated, the cam follower and strand guide move the strand longitudinally back and forth across the outer surface of the rotating package to lay each successive course. A rotatable cylindrical member, or roller bail, contacts the outer surface of the package as it is being built to hold the strand laid in the latest course in place at the package edges as the strand guide changes direction. The roller bail is mounted for rotation, and bearings are used to reduce the friction between the roller bail and the mounting surface. The collet and package are rotating at high speeds during winding. The contact between the roller bail and the rotating package surface causes the roller bail to rotate, and the speed of the roller bail surface is generally equal to the high rotational speed of the package surface. The roller bail has a fixed diameter which is generally less than the diameter of the collet, and may be only 10% of the collet diameter. Therefore, the roller .bail must rotate at higher revolutions per minute (RPMs) to keep the roller bail surface traveling at the same speed as the speed of the package surface. To operate effectively throughout the preferred range of package sizes and preferred collet speeds during winding the roller bail may have to rotate at 70,000 RPMs or higher.

Prior to the advent of digital waywind, the rotation of the collet and the cam were tied together by a belt so that as the collet slowed down (because as the package was built it got larger) the cam would also slow down by a corresponding amount.

Several attempts have been made to control the cam speed during package buildup. For example, U.S. Pat. No. 4,667,889 to Gerhartz discloses a yarn winding process having a traversing yarn guide. The oscillation speed of the guide is proportional to the rotational speed of the package to accommodate the increasing size of the package for a relatively constant wind angle. The speed of the traversing yarn guide rapidly increases at the beginning of various sequential steps to produce a stepped precision wind. The speed can be varied to provide deviations to avoid formation of undesirable patterns.

U.S. Pat. No. 5,056,724 to Prodi et al. discloses a winder having a computer controlled winding program generating continuous winding signals that control the rotation speed of the cam. The windings are kept within a set distance of winding ratio values that are established to avoid undesirable ribboning.

U.S. Pat. No. 5,447,277 to Schliter et al. discloses a stepwise high precision winding method in which the yarn guide reciprocation frequency is reduced as the package is built to accommodate the higher circumference of the bigger package. Each of the steps of the Schliiter process involves reducing the yarn guide reciprocation frequency during the step, but at the beginning of the next step increasing the frequency of reciprocation to a new initial frequency.

In U.S. Pat. No. 4,296,889 to Martens, a random number sequence is used to constantly vary the cam speed to avoid undesirable pattern formations.

However, it is known that some waywinds are not suitable for stable packages. Thus, it would be desirable to avoid the undesirable waywinds to enable the first laid material on the collet to be wound at acceptable waywinds even when the strand is laid down at relatively large wind angles. It is also desirable to allow the cam speed to be slowed down during the beginning stages of the package buildup, thereby allowing the beginning material to be acceptable to the customer and avoiding the need for the manufacturer to remove and scrap the beginning material before shipping the package.

SUMMARY OF THE INVENTION

This invention relates to a method of winding a fibrous strand to build a package. The method includes providing a moving strand, rotating a collet at a rotational speed to wind the strand and build a package, and rotating a cam at a rotational speed to reciprocate the strand with a strand reciprocator to lay the strand at a wind angle on the package surface as the package rotates. The strand is laid on the package surface by varying the relative rotational speed of the collet and the cam as a function of package buildup time while the wind angle remains substantially constant as a function of package buildup time.

According to this invention, there is also provided a method for winding a fibrous strand to build a package including the steps of providing a moving strand, rotating a collet at a rotational speed to wind the strand and build a package, and rotating a cam at a rotational speed to reciprocate the strand with a strand reciprocator to lay the strand at a wind angle on the package surface as the package rotates. The strand is laid on the package surface by varying the wind angle and waywind as a function of package buildup time.

According to this invention, there is also provided a method for winding a fibrous strand to build a package comprising providing a moving strand, rotating a collet at a rotational speed to wind the strand and build a package, and rotating a cam at a rotational speed to reciprocate the strand with a strand reciprocator to lay the strand at a wind angle on the package surface as the package rotates. The strand is laid on the package surface by varying a waywind as a function of package buildup time, the waywind being determined by upper and lower operating curves.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
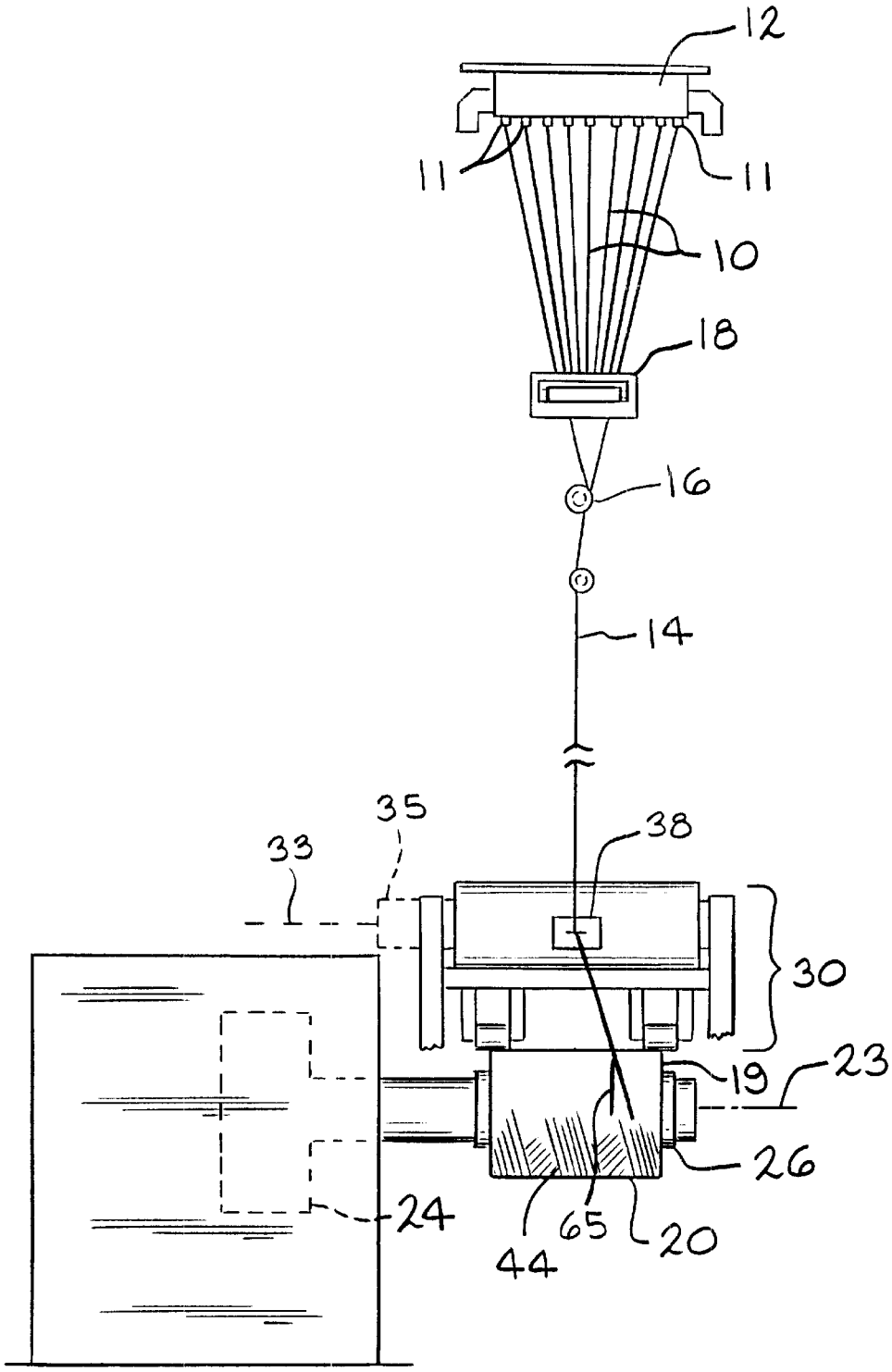
FIG. 1 is a schematic view in elevation of apparatus for forming, collecting and winding fiber strands according to the principles of the invention.
Figure 2:
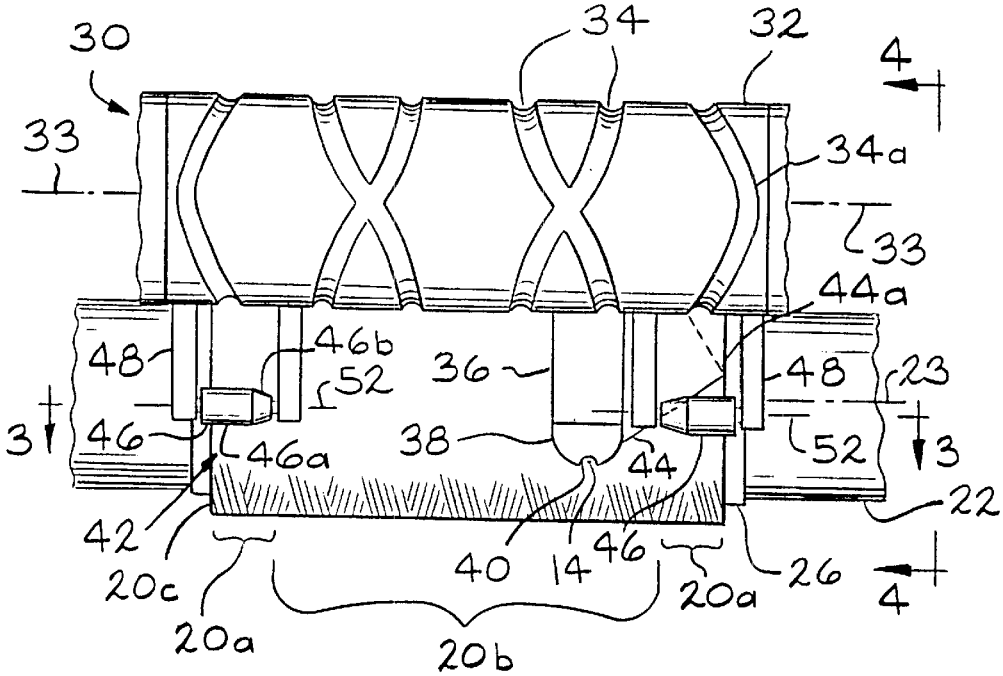
FIG. 2 is an enlarged, schematic plan view of the strand reciprocator shown in FIG. 1.

FIGS. 1 and 2 show an apparatus for forming, collecting, and winding strands in which fibers 10 are drawn from a plurality of orifices 11 in a bushing 12 and gathered into a strand 14 by means of a gathering member 16. A size suitable for coating the fibers can be applied to the fibers by any suitable means, such as size applicator 18. The strand 14 is wound around a rotating collet 22 to build a cylindrical package 19. The package 19, formed from a single, long strand, has a radially outer surface 20 with edge portions 20*a* and a central portion 20*b* between them. The edge portions 20*a* form generally right angles with the package ends 20*c*. The outer surface of the cylindrical package 19 is preferably between about 10 cm to about 40 cm long, but may be longer or shorter depending on the application. The collet 22 is adapted to be rotated about an axis of rotation 23 by any suitable means such as a motor 24. Any suitable package core material such as a cardboard tube 26 can be disposed on the collet 22 to receive the strand package 19.

A strand reciprocator 30 guides the strand 14 laterally back and forth across the package surface 20 to lay the strand in courses 44 on the package surface. The strand reciprocator 30 includes a cylindrical cam 32 having a helical groove 34. The cam 32 is adapted for rotation about an axis 33 by any suitable means such as a motor 35. The cam 32 is preferably made of a hard material, such as stainless steel, but any suitable material can be used. The strand reciprocator 30 further includes a cam follower 36 disposed in the groove 34. The cam follower 36 extends outwardly from the cam 32 and a strand guide 38 is attached to the end. The cam follower 36 is preferably made of a plastic or nylon material, but any suitable material can be used. A notch 40 is formed in the strand guide 38 to hold the strand 14. Rotation of the cam 32 causes the cam follower 36 to follow the helical groove, thereby causing the strand guide 38 to move laterally across the package surface.

Figure 3:
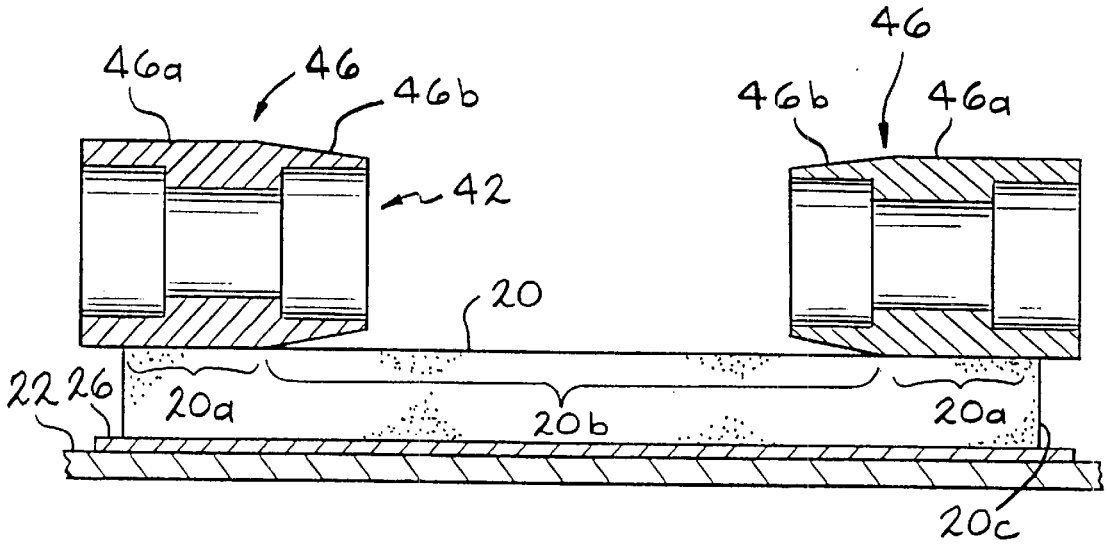
FIG. 3 is a schematic sectional view in elevation of the apparatus of FIG. 2, taken along line 3—3.

Referring now to FIGS. 2 and 3, the strand reciprocator further includes a roller bail assembly 42 for holding the strand courses 44 in place at the edge portions 20*a* of the package surface 20 as the strand guide 38 changes direction. The roller bail assembly includes a pair of spaced apart, or split rollers 46. The rollers 46 have generally cylindrical edge ends 46*a* and tapered inner ends 46*b*. The cylindrical edge ends contact the package surface at the edges 20*a*. The tapered inner ends extend from the edge ends towards the central portion of the package surface 20*b*. The rollers 46 do not contact the surface of the package at the central portion of the package 20*b*. Each of the rollers 46 is independently mounted by mounts 48. One or more bearings (not shown) are located between the roller bails and the mounts to allow the roller bails to rotate freely by reducing friction. The bearings are preferably open, ball bearing type bearings. Although the roller bails are shown as mounted at both the edge ends and the inner ends, the roller bails may be cantilevered, being mounted at only one end. Each roller is made from a hard material, such as stainless steel, but any suitable material may be used. The rollers preferably weigh approximately 50 grams each, but may be heavier or lighter depending on their size and the application. They are preferably hollow to minimize weight and inertia, but may be solid. Each roller is preferably about 2 cm long, but they may be longer or shorter depending on the application.

The split roller bails are preferably coaxial, contacting the package surface along a portion of a line 52 which is generally parallel to the package axis of rotation 23, although, any suitable orientation of the roller bails may be used. Using 2 cm long roller bails, the length of contact between the roller bails and the typical package surface will be approximately 10% to 50% of the length of the outer surface of the package. A longer or shorter length of contact between the roller bails and the package surface may be used depending on the application.

Figure 4:
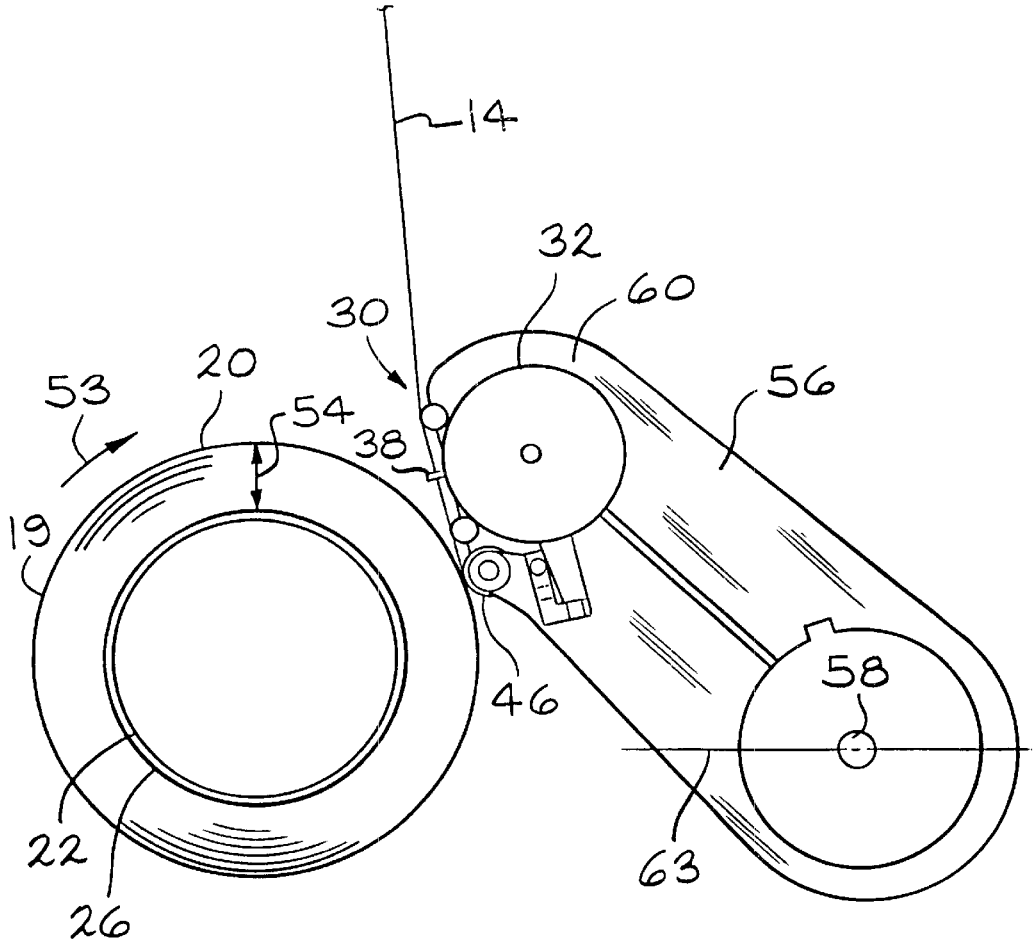
FIG. 4 is an end view in elevation of a portion the roller bail assembly of FIG. 1.

The package rotates during winding as shown by line 53 in FIG. 4. As the package builds, the radius 54 increases. To accommodate the increasing package radius, the strand reciprocator 30 is mounted on an arm 56. To accommodate the increasing package radius, the arm moves away from the collet along line 63 to keep the proper contact between the surface of the rollers and the package surface, and to prevent the strand courses 44*a* from pulling away from the edge portions 20*b* of the package surface.

Figure 5:
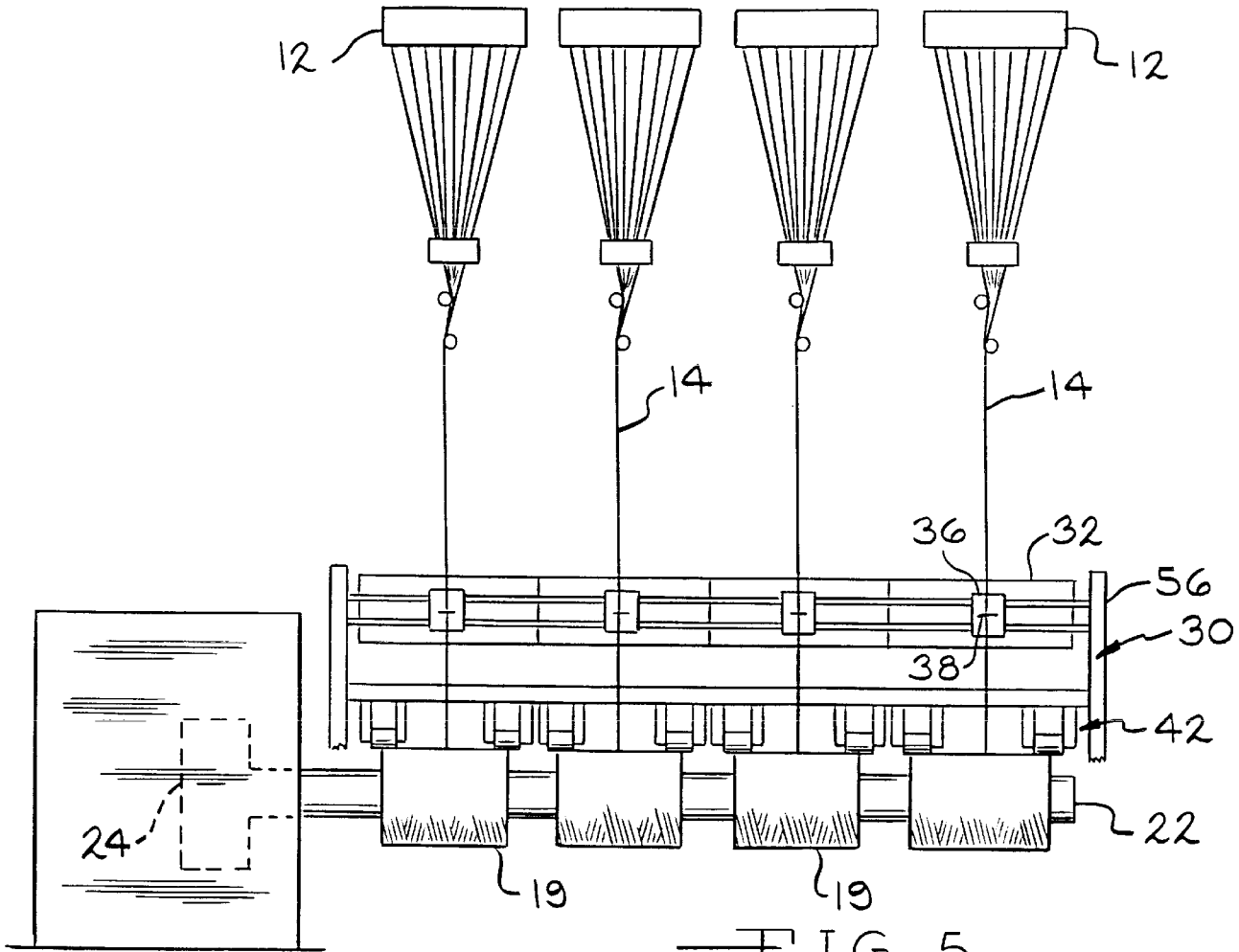
FIG. 5 is a diagrammatic view of an alternate embodiment of the invention showing the building of multiple packages on a single collet.

Several packages can be built simultaneously on the collet, as shown in FIG. 5. Each package is built by drawing separate strands 14 from separate bushing sections. The strands are wound around a single collet 22 to form packages 19. A separate strand reciprocator, including cam 32, cam follower 36, strand guide 38 and roller bail assembly 42, is used to build each package. The packages are spaced apart along the collet and the strand reciprocators are spaced along the arm 56 in a similar manner so as to be aligned with the packages.

In operation, the strand reciprocator 30 guides the strand 14 as it is laid on the outer surface of the package. The strand is held by notch 40 in the strand guide 38 and wound around the rotating collet 22 or a package core 26 disposed about the collet. The cam 32 is oriented near the package and rotates about the axis 33 generally parallel to the package axis of rotation 23. The cam follower is disposed within the cam groove 34, but is prevented from rotating with the cam. As the cam rotates, the cam follower is moved laterally by the helical groove in a direction generally parallel to the package axis of rotation 23. The helical groove is continuous, having curved ends 34*a* that cause the cam follower to move to the end of the package and then reverse direction. The strand guide is attached to the cam follower and it traverses the outer surface of the package, reciprocating back and forth from end to end. The strand guide does not contact the surface of the package.

The helical winding pattern of each strand course 44 is formed by reciprocating the strand across the package surface while rotating the package. As the strand guide approaches the edge of the package 20*a*, the strand is laid on the package surface under the roller tapered inner ends 46*b*. The strand guide continues to move towards the edge 20*c* of the package and the strand course, shown in phantom at 44*a* in FIG. 2, moves between the package surface and the cylindrical edge end of the roller which is in contact with the package surface. When the cam follower travels through the curved end 34*a* of the groove 34, the strand guide 38 changes direction and moves away from the package edge 20*c* and towards the central portion of the package 20*b*. The contact between the roller bails and the package surface holds the strand course 44*a* in place at the edge of the package surface 20*a*, when the strand guide 38 changes direction. By preventing the strand courses 44*a* from pulling away from the package edges 20*c* as the strand guide 38 moves back towards the center of the package 20*b*, a cylindrical package having square edges 20*c* is built. It will be appreciated that it is not necessary for the roller bails to contact the package surface for building a cylindrical package having square edges 20*c*. A preferred method of forming the cylindrical package is to have the strand guide 38 contacting the package surface.

It is highly desirable to form a package having substantially square edges while decreasing the average rotational speed of the cam 32 during package buildup. To accomplish this, the invention contemplates a precision winding method for controlling the wind angle and the waywind. As used herein, the waywind is defined as the number of rotations of the collet 22 needed for the strand guide 38 to travel from one end of the package to the other end. Thus, the waywind may be a function of the rotational speed of the collet, the diameter of the package, and the rotational speed of the cam. As used herein, the wind angle is defined as the angle of the strand 14 with respect to a line 65 that is tangent to the package surface 20*a* and is parallel to the package edge 20*c*, as shown in FIG. 1.

Figure 6:
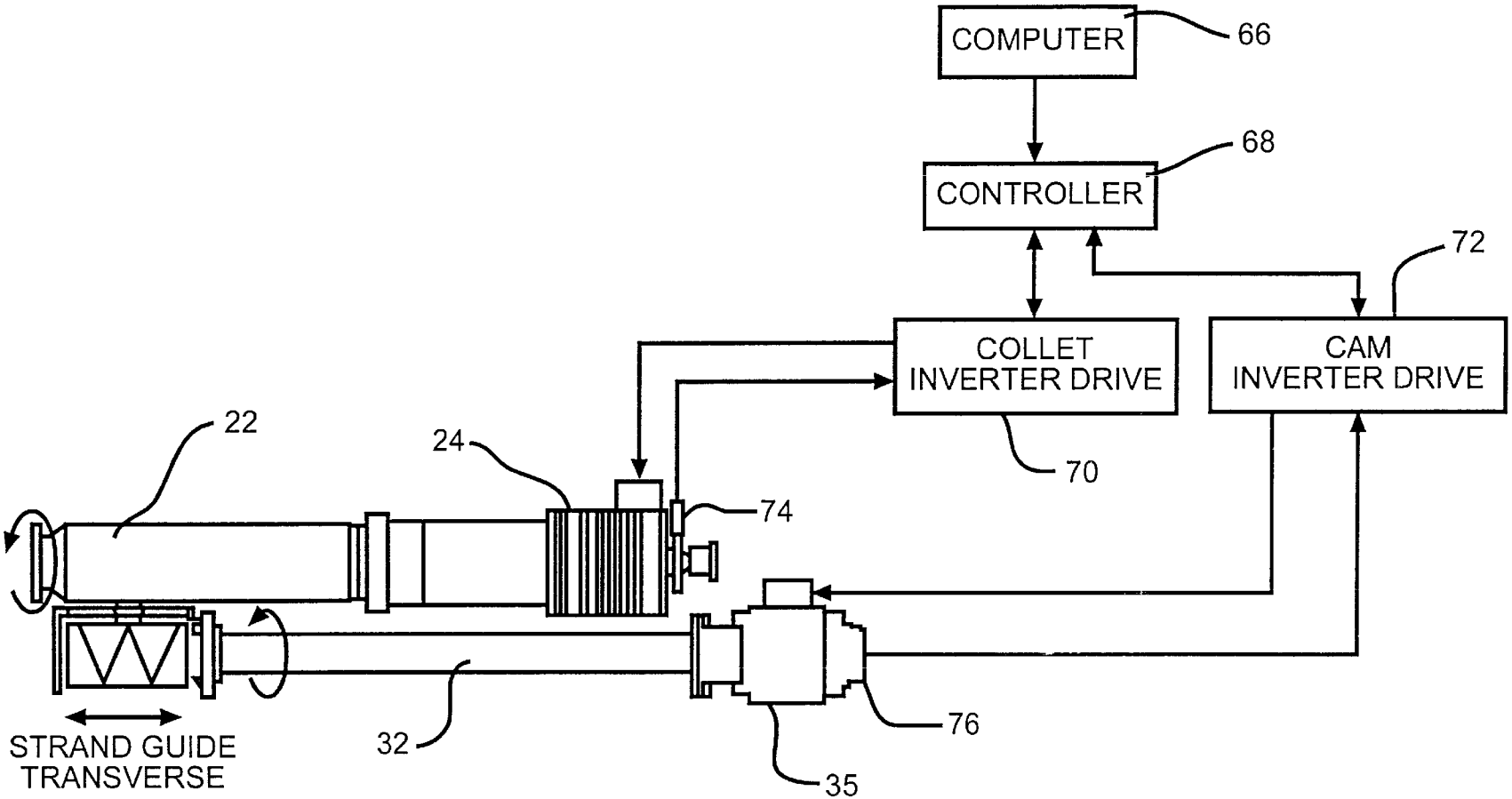
FIG. 6 is a block diagram of the control system for the apparatus of the invention.

The precision winding method of the invention can be accomplished in two ways: (1) a constant wind angle and a variable waywind, and (2) a variable wind angle and a variable waywind. Referring now to FIG. 6, the apparatus further includes a memory storage device such as a personal computer 66 that can store data and execute a computer program. The computer 66 is operatively connected to a controller 68 such as a programmable logic controller (PLC). The controller 68 is also operatively connected to a collet inverter drive 70 for driving the motor 24 and a cam inverter drive 72 for driving the motor 35. The inverter drives 70, 72 are capable of controlling the motors 24, 35 to select a rotational speed of the collet and the cam, respectively. Each motor 24, 35 may be equipped with an encoder 74, 76 to provide feedback information to the controller 68 relating to the rotational speed of each motor 24, 35. The computer 66 can provide the controller 68 with a series of reference values for the rotational speed of the collet and the cam as a function of time for the package buildup. The controller 68 can send a signal to the collet inverter drive 70 and the cam inverter drive 72 to control the rotational speed of the collet and cam, respectively. These values may be contained in one or more lookup tables of the wind angles and waywind as a function of time for the package buildup.

Figure 7:
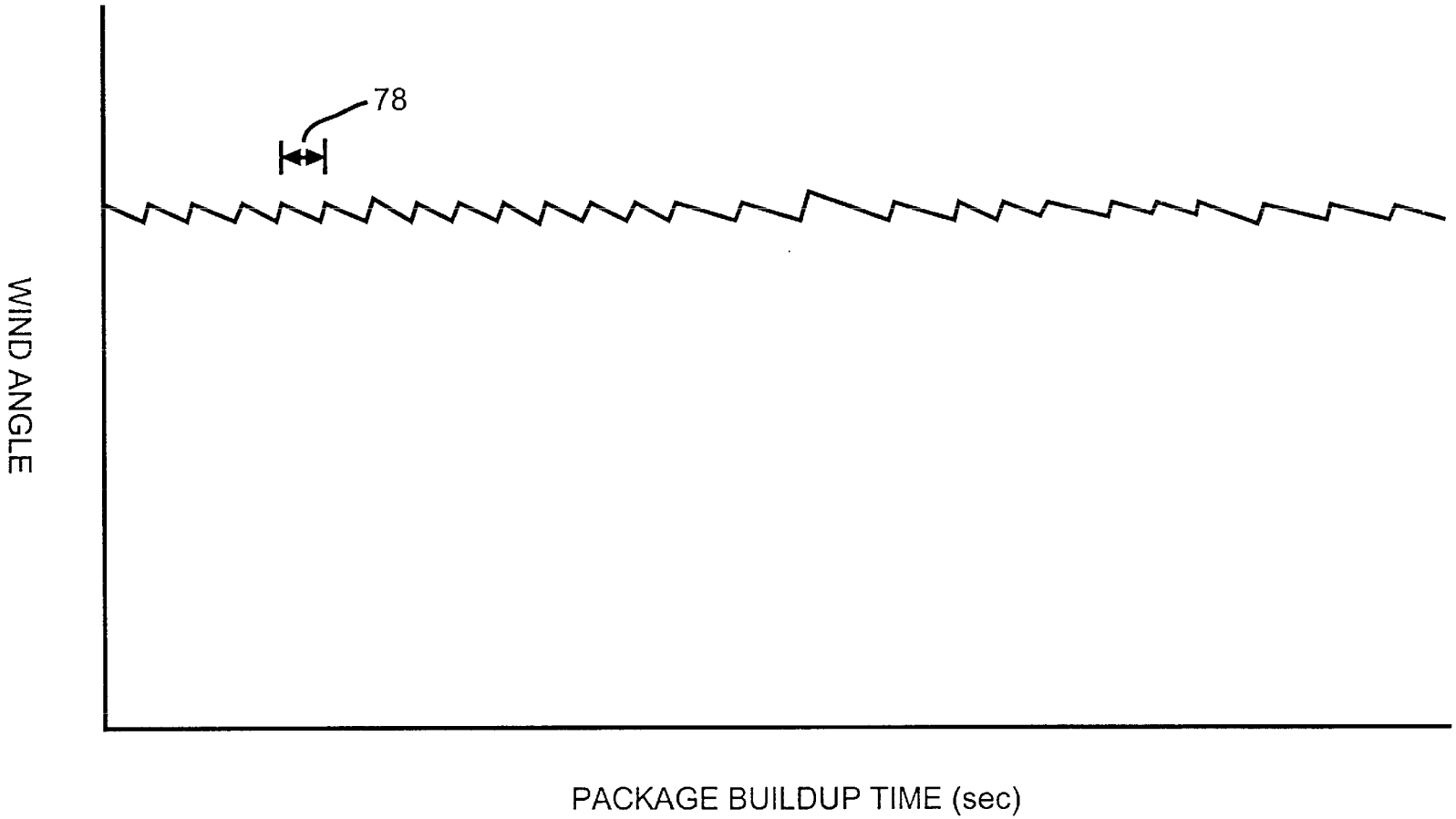
FIG. 7 is a graph of wind angle as a function of package buildup time according to a first method of the invention.
Figure 8:
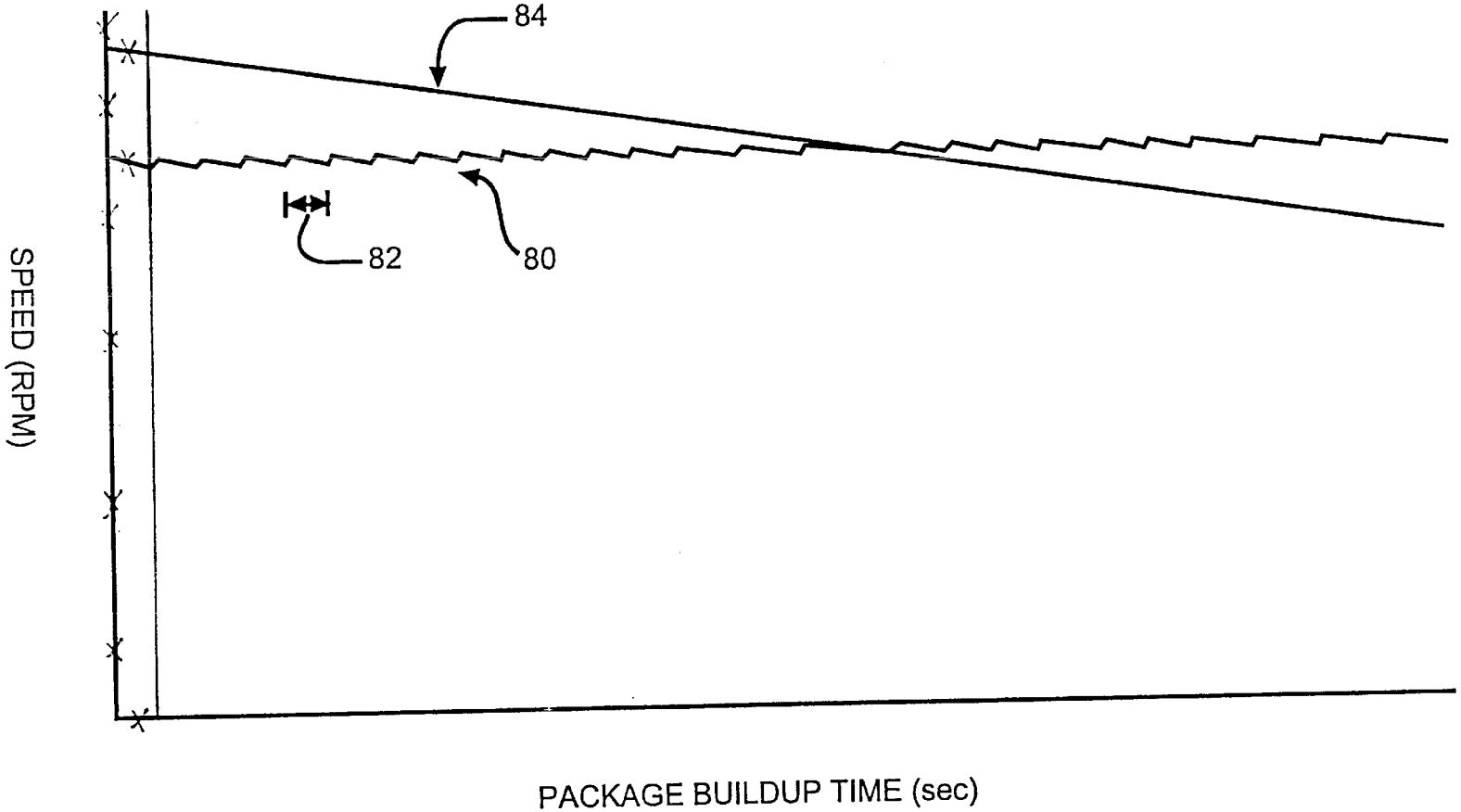
FIG. 8 is a graph of rotational speed of the collet and the cam as a function of package buildup time according to the first method of the invention.

FIGS. 7 and 8 show the precision winding method according to the first method of the invention. In this method, the wind angles remain substantially constant as a function of package buildup time. For example, the wind angle can be defined as a series of incremental steps 78 in which the wind angle slowly decreases for a predetermined period of time, for example about 20 seconds, and then rapidly increases, and then slowly decreases in the next step 78, as shown in FIG. 7. The decreased wind angle is brought about by a slowing of the cam speed, and the increased wind angle is caused by an increase in cam speed.

It will be appreciated that there are many different ways in which the wind angle can remain substantially constant as a function of package buildup time. In an alternative method, the wind angle can be defined as a series of incremental steps 78 in which the wind angle remains constant for a predetermined period of time, and then rapidly increases or decreases, and then remains substantially constant at a different wind angle for another predetermined period of time. In another alternative method, the wind angle can slowly increase during the incremental step 78 for a predetermined period of time before rapidly decreasing in a step-wise fashion. It should be understood that the net effect of all these methods is that the wind angle remains substantially constant over the package buildup time.

In addition, the first method of the invention also uses a variable waywind, as shown in FIG. 8. A variable waywind can be achieved in several different ways. One way is to decrease the rotational speed of the collet while the rotational speed of the cam remains generally constant, thereby producing a variable waywind ratio. The generally constant rotational speed of the cam, shown generally at 80, can be accomplished using a series of small incremental steps 82 in a manner similar to the generally constant wind angle. Although the rotational speed of the cam 80 is generally constant, the rotational speed of the collet, shown generally at 84, generally decreases as a function of package buildup time. As shown in FIG. 8, the collet speed linearly decreases as a function of package buildup time. However, it will be appreciated that this function may be linear or non-linear.

The first method of the invention alleviates problems associated with conventional winders. First, the first method of the invention controls the wind angle and waywind to produce a package 19 having substantially flat edges 22*c*, regardless of the size of the package. Second, the constant wind angle of the first method of the invention alleviates the problem associated with conventional winders in which the wind angle decreases during package buildup, thereby limiting the size of the package.

Figure 9:
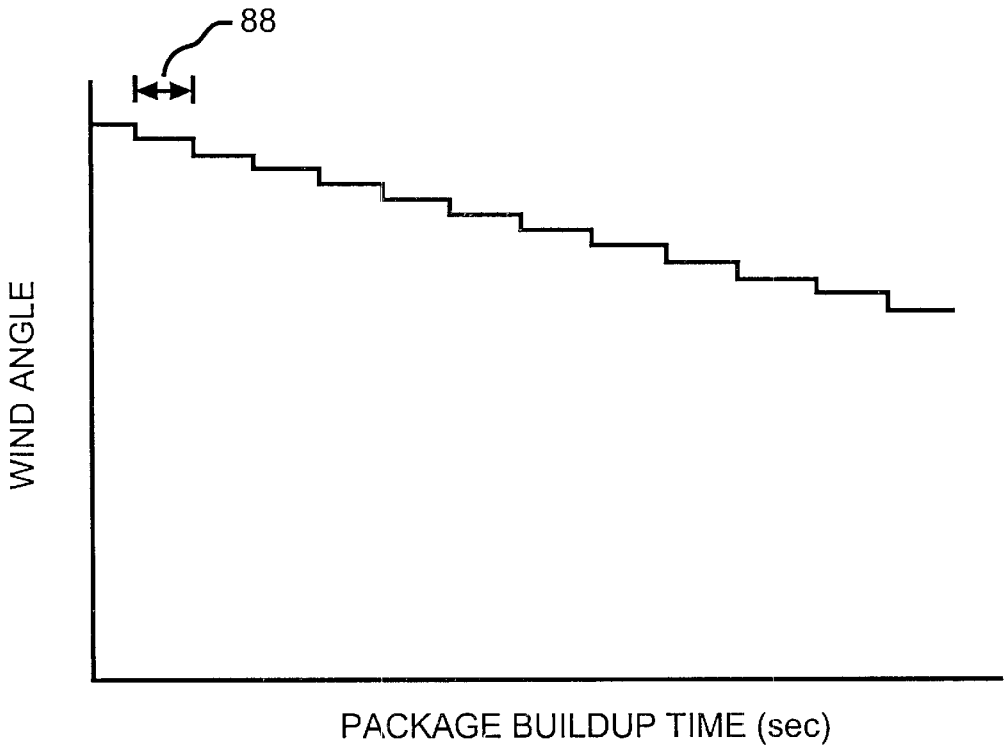
FIG. 9 is a graph of wind angle as a function of package buildup time according to a second method of the invention.
Figure 10:
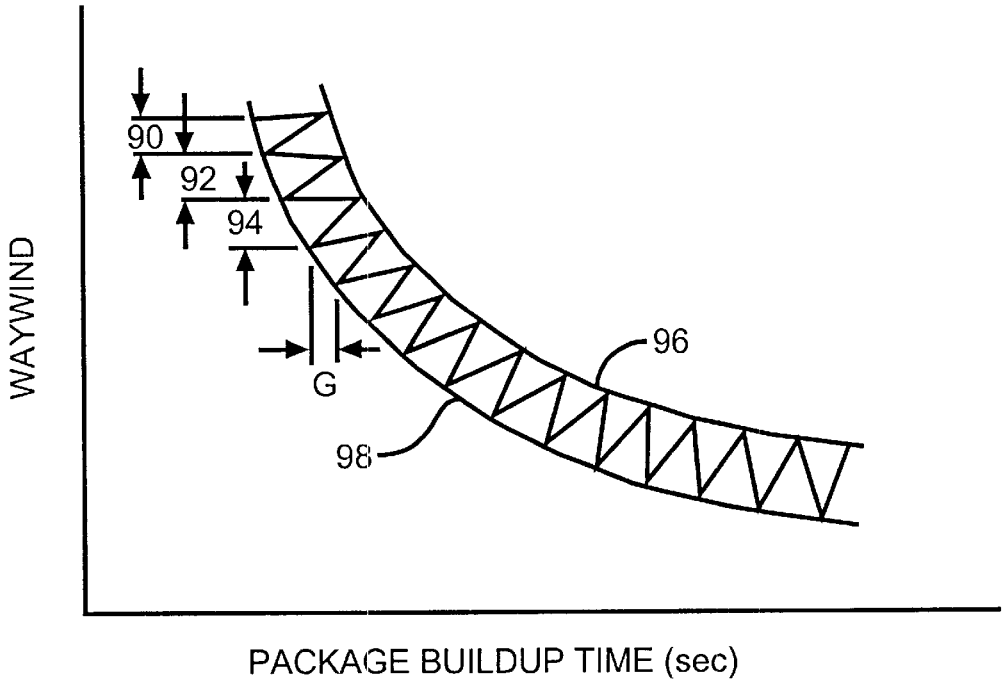
FIG. 10 is a graph of waywind as a function of package buildup time according to the second method of the invention.

FIGS. 9 and 10 show the precision winding method according to the second method of the invention. In this method, the wind angles are defined by a series of steps 88 in which the wind angle slowly decreases during package buildup. In addition, the precision winding method also uses a variable waywind, as shown in FIG. 10. A variable waywind can be achieved in several different ways. One way is to decrease the waywind in a series of steps, such as steps 90, 92, 94 and additional steps, to form a function with decreasing slope. The length of each step can be a function of the amount or gain, G, that the strand advances or declines during each waywind cycle. Alternatively, the waywind as a function of package buildup time can be defined by an upper operating curve 96 and a lower operating curve 98. The desirable waywind during package buildup is defined as the waywind between the upper and lower operating curves 96, 98. A waywind outside of the curves 96, 98 would be undesirable. As shown in FIG. 10, the waywind as a function of package buildup time is non-linear. For example, the waywind function can be calculated as the inverse of the square root of the package diameter. However, it will be appreciated that the function may be linear or non-linear.

The second method of the invention can be practiced with a wide variety of variable wind angles and waywinds. In an alternative method, the wind angle may increase as the waywind decreases as a function of package buildup time to provide optimum winding angles during package buildup. The computer software can control the wind angle for either a constant wind angle, an increasing wind angle, or a decreasing wind angle during the building of the package. In addition, it will be appreciated that the use of the computer program allows for the precise control of the wind angle and waywind as a function of package buildup time, as compared to conventional winders that vary only the wind angle.

As described above, the first and second methods of the invention alleviate problems associated with conventional winders by controlling the wind angle and the waywind to produce a package having substantially flat edges. By starting out at a slower speed using the first method of the invention, the average speed can be lowered, thereby enabling longer machine life. Alternatively, the gain can be taken in higher throughput at the same cam speed. By using the second method of the invention, the average cam speed may decrease slightly, but it offers a simpler control method compared to the first method of the invention.

In addition to the first and second methods of the invention, the invention contemplates variations in which the wind angle and the waywind can vary with respect to the package buildup time in many different ways. For example, the wind angle and waywind can be programmed to be substantially different during a first portion of the package buildup when the first few strands are wound on the collet than during a second portion of the package buildup when the remainder of the package is formed. It is preferred that the cam speed during the first portion of the package buildup is substantially slower than the second portion of the package buildup. By starting the package build at a slower speed, the average speed of the cam can be decreased, thereby enabling longer machine life. In addition, the decrease in the average speed of the cam will allow an increase in the throughput of the strand to produce the same cam speed as conventional winders, thereby increasing efficiency of the winding process. Further, the slower initial speed of the cam increases the likelihood that the strands during the first portion of the package buildup will be acceptable to the customer, thereby alleviating the need for the manufacturer to remove and discard the beginning material before shipping the package.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method of winding a fibrous strand to build a package, the method comprising the steps of:

(a) providing a moving strand;

(b) rotating a collet at a rotational speed to wind the strand and build a package;

(c) rotating a cam at a rotational speed to reciprocate the strand with a strand reciprocator to lay the strand at a wind angle on the package surface as the package rotates; and (d) varying the rotational speed of the cam to vary a waywind as a function of package buildup time and between upper and lower waywind operating curves to avoid waywinds outside the waywind operating curves; wherein step (d) comprises the step of varying the rotational speed of the cam so that the rotational speed of the cam is slower when starting a package buildup and then increases.

2. The method defined in claim 1, further comprising the step of varying the wind angle as a function of package buildup time.

3. The method defined in claim 2, further comprising the step of varying the wind angle so that the wind angle is greater at a first portion of the package buildup than at a second portion of the package buildup.

4. The method defined in claim 1, wherein step (d) comprises the step of varying the rotational speed of the cam by a series of incremental steps in which the waywind decreases as a function of the package buildup time.

5. The method defined in claim 1, wherein step (d) comprises the step of varying the rotational speed of the cam by a series of incremental steps in which the waywind varies as the wind angle varies.

* * * * *